United States Patent [19]

Spillar

[11] Patent Number: 4,838,595

[45] Date of Patent: Jun. 13, 1989

[54] REEL LIFTING DEVICE

[75] Inventor: Robert J. Spillar, Tulsa, Okla.

[73] Assignee: Tulsa Power Products, Inc., Tulsa, Okla.

[21] Appl. No.: 194,280

[22] Filed: May 16, 1988

[51] Int. Cl.[4] ..... B66C 1/66

[52] U.S. Cl. ..... 294/90; 294/97

[58] Field of Search ..... 294/19.1, 26, 67.1, 294/82.24, 82.31, 86.4, 89, 90, 93, 95, 97, 158

[56] References Cited

U.S. PATENT DOCUMENTS

| | | | |
|---|---|---|---|
| 2,601,999 | 7/1952 | Sly | 294/26 X |
| 2,789,859 | 4/1957 | Woellner | 294/97 X |
| 3,132,890 | 5/1964 | Beaudet | 294/97 X |
| 3,307,871 | 3/1967 | Russell et al. | 294/97 X |
| 3,583,753 | 6/1971 | McCrory | 294/86.4 |

FOREIGN PATENT DOCUMENTS

| | | | |
|---|---|---|---|
| 619928 | 5/1961 | Italy | 294/97 |
| 775278 | 11/1980 | U.S.S.R. | 294/97 |
| 931658 | 5/1982 | U.S.S.R. | 294/97 |

*Primary Examiner*—Johnny D. Cherry
*Attorney, Agent, or Firm*—Head & Johnson

[57] ABSTRACT

A lifting device for grasping an object having a hole therethrough, the device being formed of a tubular support member having an elongated toggle member pivoted at one end, the toggle member being pivoted between a longitudinal position in alignment with the support member and a transverse position perpendicular to the support member, and a lifting member slideably received within the upper end of the tubular support member, the lifting member having an eyelet for attaching a lifting cable thereto. The improvement in the device includes a spring within the tubular support member having one end affixed to the lifting member and the other end to a cable extending to the toggle member. The toggle member is weighted such that it normally returns to the inoperative longitudinal position except when the lifting member is in an upward position and the spring applies tension to the cable, pivoting the toggle member to the operative transverse position.

1 Claim, 2 Drawing Sheets

REEL LIFTING DEVICE

SUMMARY OF THE INVENTION

This disclosure is an improvement in a reel-lifting device described in the U.S. Pat. No. 3,583,753 issued on June 8, 1971. The lifting device described in the above mentioned patent has been a commercially successful product and is frequently applied for lifting heavy objects, such as reels, or any other object having an opening through which the lower portion of the device can pass, after which the device is actuated to interlock with the object to be lifted. While the device shown in the issued patent has proved to be successful, the present disclosure includes important improvements which make the device easier and safer to use.

The lifting device of this disclosure includes an upright tubular support member. The lower end of the tubular support member is slotted and receives a toggle member pivoted about a pin. The toggle member is an elongated element which is pivotable to an inoperative position wherein it is aligned longitudinally relative to the tubular support member and to an operative position wherein the toggle member extends transversely of the tubular support member.

Slideably positioned within the upper end of the tubular support member is a lifting member. The distance of movement of the lifting member is limited by means of slots formed in the opposed walls of the tubular support member with a pin extending through the lifting member and through the slots. Thereby the slots provide upper and lower limits of movement of the lifting member. The upper end of the lifting member has a means for attachment of a lifting cable so that the lifting mechanism, and any load which is engaged by the lifting mechanism, may be lifted.

Within the tubular support are two additional elements. The first is an elongated spring having an upper end thereof affixed to the lower end of the lifting member. A cable is affixed to the lower end of the spring and the other end of the cable is attached to the toggle member at a point of attachment displaced away from the point of pivotation of the toggle member. The toggle member is elongated and has a first portion extending in one direction from the point of pivotation and a second portion extending in the opposite direction from the point of pivotation. The first portion is specifically designed to be heavier than the second portion so that the toggle member, when not otherwise restrained, will always automatically pivot to the longitudinal or non-operative position.

When the toggle member is in the non-operative longitudinal position the lower portion of the lifting device can be lowered through an opening, such as an opening in a reel. After the lower end of the lifting device passes through an opening, a stop member extending from the outer surface of the support member terminates the downward movement of the lifting device. This causes the lifting member to be moved to its downward position as all lifted loads is removed from it, permitting the toggle member to pivot to its operative position. Thereafter, upward force on the lifting member will cause the toggle member to pivot from the inoperative to the operative position, that is, from the position wherein the toggle member is longitudinal of the support member to the position wherein it is transversed to the support member. In such transverse attitude the toggle member engages the reel or other device to be lifted and as further upper force is applied on the lifting member, the reel or other load is lifted.

When the reel or other load is set down and the lifting device is permitted to settle downwardly to the place where the stop member engages the upper surface of the load, the toggle member will again pivot to the inoperative position, allowing the device to be removed from the load.

An important improvement in the present invention includes the use of an extendable spring within the tubular support member by which a cable is attached between the toggle member and the lifting member. In addition, the first portion of the toggle member is heavier than the second portion so that the toggle member always pivots back to the inoperative position when it is not constrained to the operative position by upward force applied on the lifting member.

A better understanding of the invention will be had by reference to the following descriptions and claims taken in conjunction with the attached drawings.

DESCRIPTION OF THE VIEWS

DESCRIPTION OF THE PREFERRED EMBODIMENT

Figure 1:
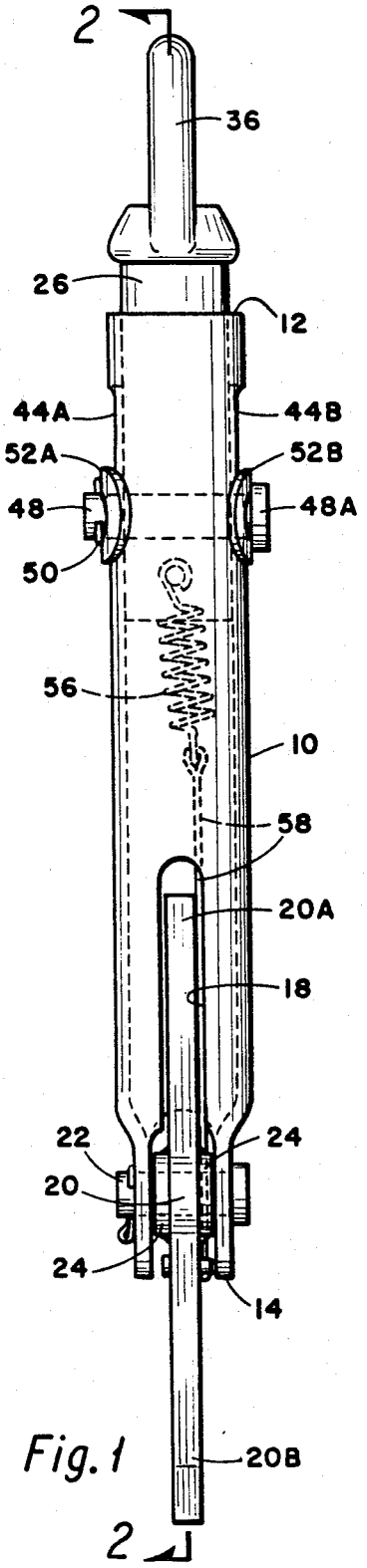
FIG. 1 is an elevational view of the improved lifting member of this invention with the toggle member shown in the inoperative position.
Figure 2:
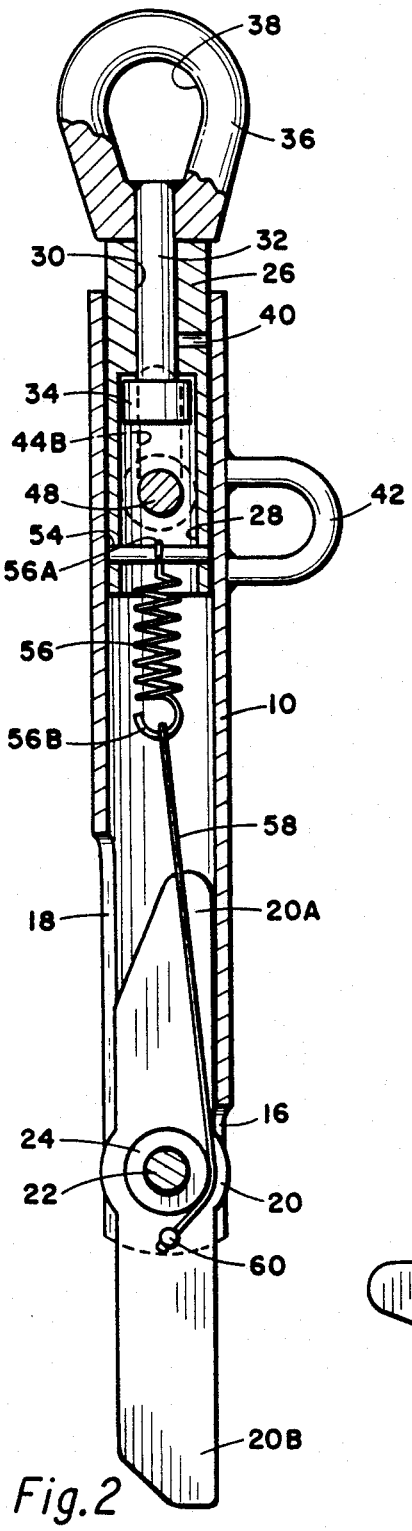
FIG. 2 is a cross-sectional view taken along the line 2—2 of FIG. 1 showing more details of the construction of the improved lifting member.
Figure 3:
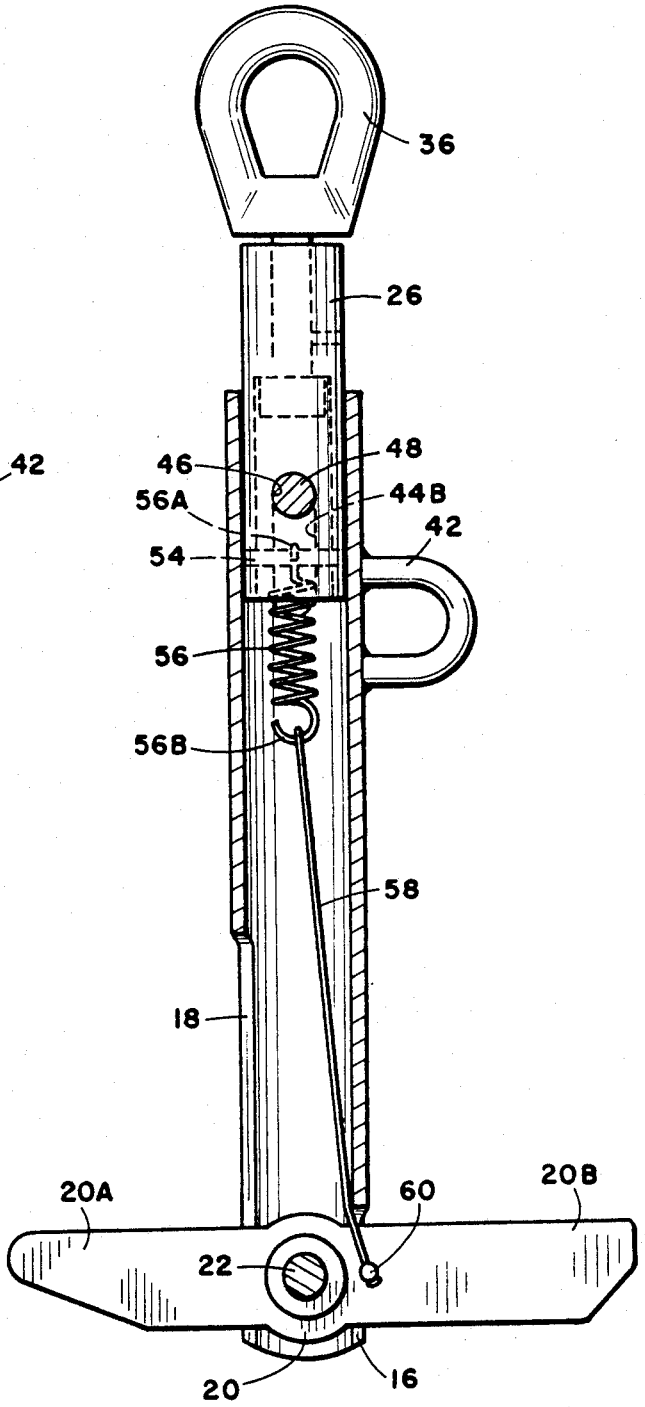
FIG. 3 is a cross-sectional view, as in FIG. 2, but showing upward force having been applied on the lifting member and showing the toggle member pivoted to the operative position.

Referring to the drawings, in FIGS. 1, 2 and 3 the preferred embodiment of the invention is illustrated. The device includes a tubular support member 10 having an upper end 12 and a lower end 14. The tubular support member has in the lower portion thereof, a first relatively short-length slot 16 and on the opposite side thereof a longer slot 18.

Pivotally supported adjacent the lower end of the tubular support member 10 is a toggle member 20 which is pivoted about a pin 22 and having washers 24 which function as spacers and are positioned to either side of the toggle member 20. The washers ensure that the toggle member 20 is held centrally-positioned with respect to the tubular support member 10.

The toggle member 20 has oppositely disposed portions 20A and 20B. Each portion is slightly tapered at the outer end, but the taper on the first portion 20A is greater so that the toggle member is unbalanced; that is, the portion 20B is greater in weight than portion 20A so that, unless otherwise restrained, the heavy end 20B will automatically pivot downward to the position as shown in FIGS. 1 and 2.

Slideably received within the upper end of the tubular support member 10 is a lifting member 26 which is preferably of cylindrical cross-sectional configuration. The lower interior position of the lifting member has a cylindrical recess 28 therein and the upper end has an opening 30 extending from the cylindrical recess through the top of the member.

Received within opening 30 is a lifting bolt 32 having an enlarged diameter head 34 at the lower position which is rotatably received within the cylindrical recess 28. Affixed to the upper end of the lifting bolt 32 is a connector portion 36. The connector portion 36 has an opening 38 therethrough so that a cable or other means may be extended through the opening as a means of lifting the entire device.

The diameters of lifting bolt 32 and head 34 are such that the lifting bolt and head freely rotate within the lifting member 26. After a load is lifted by the device, the load can be rotated relative to the connector portion 36. A small diameter opening 40 is formed in the lifting member 26 to receive grease. When the lifting member 26 is extended relative to the tubular support member 10 as shown in FIG. 3, grease can be injected into the small opening 40 by the use of a grease gun with a rubber tip to ensure a low friction rotational relationship between the lifting bolt 32 and the lifting member 26.

A U-bolt 42 is welded at each end to the external surface of the tubular support member. The U-bolt 42 serves the dual function of providing a stop as the tool is lowered into an opening in a reel or other load and in addition, provides facilities for attaching a cable as a second means by which the tubular support member may be lifted.

Formed in the opposed cylindrical side walls of the upper portion of the tubular support member 10 are slots 44A and 44B. Received in slots 44A and 44B, and also in an opening 46 formed in the lower porton of lifting member 26, is a bolt 48. As shown in FIG. 1, the bolt has a head 48A on one end and a cotter pin 50 extends through the bolt at the other end. Curved washers 52A and 52B are received on the bolt 48. By means of the slots 44A and 44B the lifting member 26 is longitudinally positioned relative to tubular support member 10 and is slideable for a limited distance determined by the length of the slots.

Positioned within the lower end portion of the lifting member 26 is pin 54. A coiled spring 56 has the upper end 56A attached to pin 54. The lower end 56B of the spring receives the upper end of a cable 58.

A small pin 60 is secured to the toggle member heavy end portion 20B adjacent to the central pin 22.

Figure 4:
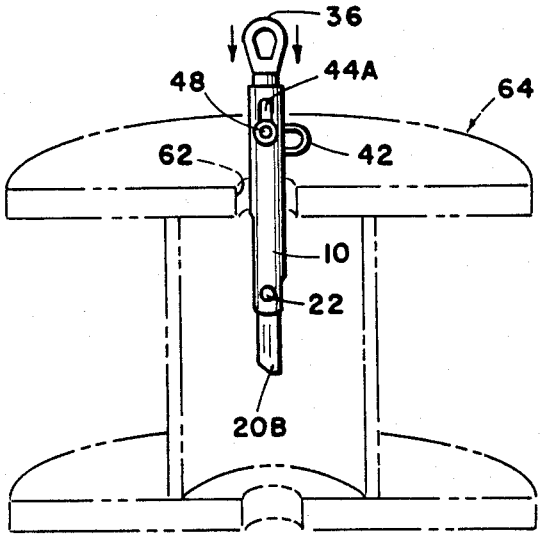
FIG. 4 is a diagrammatic view showing a reel in dotted outline and an improved lifting member of the present disclosure in reduced scale with the lifting member lower portion having been moved through an opening in the reel.
Figure 5:
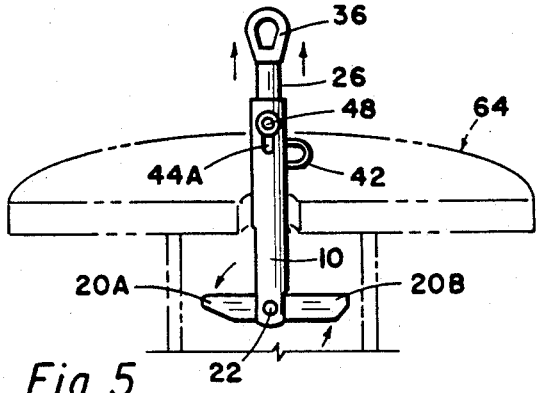
FIG. 5 is a view showing the upper portion of the reel in dotted outline and showing upward force applied to the improved lifting member and showing the toggle member pivoted into the operative position.
Figure 6:
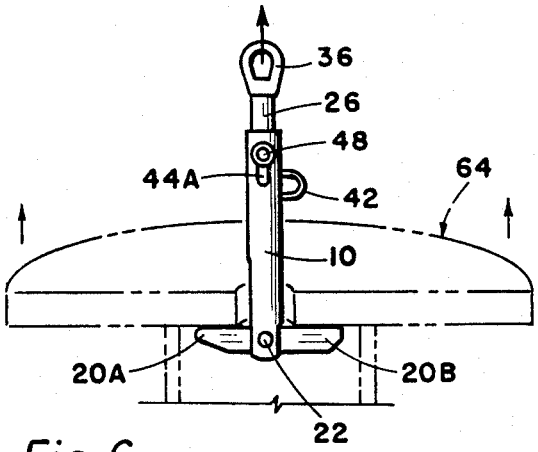
FIG. 6 is a view, as in FIGS. 4 and 5, showing additional force having been applied to the lifting member so as to move the toggle member into engagement with the lifting member to thereby lift the reel.

Referring to FIGS. 4, 5 and 6, the method of operation of the device is shown. A lifting cable (not shown) such as would extend from a crane or other type device utilized for lifting a heavy member is attached to the connection portion 36. With the toggle member 20 in the aligned position as in FIGS. 1, 2 and 4, the lower portion of the device is dropped through an opening 62 in a reel indicated in general by numeral 64, the reel being shown in dotted outline. The device is lowered into position until the U-bolt 42 engages the top surface of the reel. When upward pull is applied on the connector portion 36, the lifting member 26 will be pulled upwardly relative to the tubular support member 10 as the bolt 48 slides within slots 44A and 44B. As the lifting member moves upwardly, pull is exerted on spring 56 and thereby on cable 58 which rotates the heavy end portion 20B of the toggle member to the lifting position as shown in FIGS. 3 and 5. Further upward pull on the lifting member 26 will cause the toggle member to engage the interior upper surface of the reel and thereby the reel 64 may be lifted.

After the reel 64 is lifted off the surface on which it is resting the reel may be rotated without rotating the cable to which the device is attached because of the rotational relationship between bolt 32 and lifting member 26 as previously described.

It can be seen that the use of spring 56 serves to ensure that the toggle member 20 remains in the transverse position when upward pull is applied to the lifting member 26. The use of the spring allows slight variation in the length of cable 58; that is, if the cable 58 is slightly too short, then such will only cause an extension of spring 56. In the manner illustrated, none of the weight of lifting the reel 64 is transferred to the cable 58. The use of spring 56 combined with the arrangement of the toggle member having a heavier end portion 20B results in an improved lifting device. In addition, and of greater importance, if for some reason the toggle member 20 is prevented from fully rotating to the lifting postion, due for instance to an obstruction in the reel or other device being lifted, the cable 58 would be required to support the whole load except for the provision of spring 56. Therefore, spring 56 protects cable 58 and helps achieve a more trouble-free tool.

The claims in the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. In a lifting device for grasping an object having a hole therethrough, the device having an elongated tubular support member and a toggle member pivotally secured at a point of pivotation to the lower end of the support member and being moveable into an inoperative position wherein it is disposed longitudinally of the support member and an operative position wherein it is disposed transversely of the support member, the toggle member having a first portion extending in one direction from the point of pivotation and a second portion extending in the opposite direction from said point of pivotation and including a lifting member located at and connected to the upper end of the support member and being longitudinally movable relative to the support member through a predetermined distance, the lifting member having a downward, non-lifting position and an upward lifting position, the lifting member in its upper position co-acting with the support member and the toggle member to perform lifting operations, the lifting member having an upper portion for fastening to a lifting cable so that when the lifting member is moved to its upper lifting position the toggle member is pivoted to its operative position, the improvement comprising:

an extendable spring within said tubular support member having a first and a second end and having the first end affixed to said lifting member, the spring being extendable between a collapsed condition and an extended condition;

a cable within said tubular support member having a first and a second end and having the first end affixed to said spring second end and having the second end thereof affixed to said toggle member first portion at a point on said toggle member first portion displaced away from the said point of pivotation whereby when said lifting member is in its upward position said toggle member is in said operative position and said spring is in its extended condition and wherein said lifting member is in its downward position said toggle member is in it inoperative position and said spring is in its collapsed condition, and wherein said toggle member first portion is heavier than said toggle member second portion whereby when said lifting member is in its lower, non-lifting position said toggle member tends to automatically pivot to its said inoperative position.

* * * * *